US005487689A

United States Patent [19]

Floryan et al.

[11] Patent Number: 5,487,689

[45] Date of Patent: Jan. 30, 1996

[54] HIGH THROUGHPUT ASSEMBLY STATION AND METHOD FOR IMAGE INTENSIFIER TUBES

[75] Inventors: Richard F. Floryan, Roanoke, Va.; David D. Frisch, Fort Wayne, Ind.

[73] Assignee: ITT Corporation, New York, N.Y.

[21] Appl. No.: 290,380

[22] Filed: Aug. 15, 1994

[51] Int. Cl.[6] ..... H01J 9/24; H01J 9/38; H01J 9/48

[52] U.S. Cl. ..... 445/29; 445/44; 445/67; 445/70; 445/71

[58] Field of Search ..... 445/29, 40, 44, 445/71, 67, 70, 14, 17

[56] References Cited

U.S. PATENT DOCUMENTS

| | | | |
|---|---|---|---|
| 2,699,371 | 1/1955 | Meister | 445/17 |
| 3,334,955 | 8/1967 | Day . | |
| 4,175,808 | 11/1979 | Pakswer et al. . | |
| 4,286,833 | 9/1981 | Patrick et al. . | |
| 4,309,066 | 1/1982 | Patrick et al. . | |
| 4,799,911 | 1/1989 | Relder | 445/70 |
| 5,029,963 | 7/1991 | Naselli et al. . | |
| 5,314,363 | 5/1994 | Murray . | |

FOREIGN PATENT DOCUMENTS

| | | | |
|---|---|---|---|
| 0299627 | 1/1989 | European Pat. Off. . | |
| 696557 | 11/1979 | U.S.S.R. | 445/40 |
| 1143536 | 2/1966 | United Kingdom . | |

*Primary Examiner*—P. Austin Bradley
*Assistant Examiner*—Jeffrey T. Knapp
*Attorney, Agent, or Firm*—Plevy & Associates; Patrick M. Hogan

[57] ABSTRACT

An automation system for assembling photocathodes into vacuum tube housings is used to produce vacuum tube assemblies. Photocathodes are loaded and otherwise processed in a first evacuated chamber. Similarly, vacuum tube housings are loaded and otherwise processed in a second evacuated chamber. The first and second chambers are always interconnected as a common vessel, wherein the photocathodes from the first chamber are transferred into the second chamber by an automated transfer mechanism. Once in the second chamber, the photocathodes are joined to the vacuum tube houses in an automation process, creating the final product vacuum tube assemblies.

20 Claims, 7 Drawing Sheets

HIGH THROUGHPUT ASSEMBLY STATION AND METHOD FOR IMAGE INTENSIFIER TUBES

FIELD OF THE INVENTION

The present invention relates to an automated system for producing image intensifier tubes and more particularly to such systems that bake, outgas, evacuate and seal image intensifier tubes in a time and labor efficient manner.

BACKGROUND OF THE INVENTION

Image intensifier tubes are well known de,rices that multiply the amount of incident light received and produce an intensified image that can be more easily viewed. Image intensifier tubes are particularly useful in producing visible images from received infrared energy, thereby providing a means for clearly viewing an object at night or during otherwise low light conditions. As a result, devices that utilize image intensifier tubes have been used in a wide variety of industrial and military applications. For example, image intensifier tubes are commonly used for enhancing the night vision of pilots, for photographing astronomical bodies and for providing night vision to the visually handicapped such as persons suffering from retinitis pigmentosa (night blindness).

Image intensifier tubes are well known in the industry by names that are based on the generic generation from which their designs came into being. As a result, image intensifier tubes are typically identified by their generation number, which can be from the Generation 0 tube to the current Generation III (Gen. III) tube. Modern Gen. II image intensifier tubes, the manufacturing of which is the primary application of the present invention, typically include three main components, namely a photocathode, a phosphor screen (anode) and an electron amplifier such as microchannel plate. All three components are disposed within an evacuated housing thereby permitting electrons to flow from the photocathode to the phosphor screen across the electron amplifier. For examples of such devices reference is made to U.S. Pat. No. 5,029,963 entitled "Replacement Device for a Driver's Viewer" issued on Jul. 9, 1991 to C. Naselli et al. and assigned to ITT Corporation the assignee herein. Both Gen. II and Gen. III image intensifiers are discussed in this reference.

In a Gen. II image intensifier tube the phosphor screen and electron amplifier components of the image intensifier tube are contained within a tube subassembly. The tube subassembly and photocathode are traditionally manufactured separately and are then assembled to create the overall image intensifier tube structure. Referring to FIG. 1, a typical Gem II image intensifier tube 10 is shown, such as is currently manufactured by ITT Corporation, the assignee herein. As can be seen, both the tube subassembly 11 and the photocathode 25 are complex structures. The vacuum housing 12 that defines the exterior of the tube subassembly 11 is constructed by the juxtaposition of annular conductive elements and dielectric elements that are brazed together to create an air impervious structure. The lower end of the vacuum housing 12 is sealed by the presence of an screen flange 16 and a centrally positioned fiber optic element 18. The phosphor screen 20, against which electrons will eventually impinge, is disposed across the top surface 22 of the fiber optic element 18 so that the phosphor screen 20 faces the photocathode 25.

The tube subassembly 11 is manufactured in ambient pressure using traditional well-known manufacturing techniques. Similarly the body of the photocathode 25 is separately manufactured in ambient pressure also utilizing traditional well-known manufacturing techniques. When the photocathode 25 is assembled to the tube subassembly 11, the photocathode 25 seals the upper end of the tube subassembly 11, thereby isolating the interior of the image intensifier tube 10 between the photocathode 25 and the phosphor screen 20. Since a vacuum must be present within the image intensifier tube 10, the photocathode 25 must be assembled to the tube subassembly 11 in a clean, evacuated environment, thereby greatly increasing the complexity, time and cost of the overall manufacturing procedure. In the prior art, the assembly of the photocathodes 25 to the tube subassemblies 11 was traditionally done in a single evacuated chamber, two image intensifier tubes at a time. Due to the time involved in loading and unloading the evacuated chamber, evacuating the chamber, baking the chamber and waiting for pans to properly cool, the prior art assembly systems only produced about 2.5 tubes in a twenty-four hour period. Such a labor intensive and slow manufacturing process has added significantly to the cost of image intensifier tubes and has left the image intensifier tubes vulnerable to many potential manufacturing defects that affect the overall reliability of the image intensifier tubes.

An attempt at solving the foregoing problem can be found in U.S. Pat. No. 5,314,363 to Murray entitled AUTOMATED SYSTEM AND METHOD FOR ASSEMBLING IMAGE INTENSIFIER TUBES, issued on May 24, 1994 and assigned to ITT Corporation, the assignee herein. The above invention includes four different processing chambers for accomplishing various portions of the assembly task. Each of the chambers is separated from the other by at least one vacuum gate valve. Such a configuration requires multiple vacuum sources and couplings for selectively evacuating and pressurizing each of the chambers. Multiple vacuum apparatus as well as the gate valve hardware can prove to be prohibitively expensive as they add significantly to the overall manufacturing costs.

It is therefore an objective of the present invention to produce an automated assembly system capable of assembling a high volume of image intensifier tubes in a labor and time efficient manner, while at the same time reducing the amount of hardware necessary in the system.

It is a further object of the present invention to provide an automated assembly system for image intensifier tubes that produces an image intensifier tube of a higher quality and reliability than is available from the prior art.

SUMMARY OF THE INVENTION

The present invention is an automated system and method for assembling photocathodes with vacuum tube housings. The present invention system includes a photocathode processing chamber and a main tube assembly chamber capable of retaining an evacuated environment and interconnected as a common vessel. Within the photocathode processing chamber is a means for processing the photocathodes and forming a photosensitive layer of material on the surface of the photocathodes. Receptacles within the photocathode processing chamber are adapted to receive the photocathodes and are disposed upon a rotating assembly, as such, the photocathodes can be rotatably moved so as to be engaged by an automated transfer mechanism. Vacuum tube housings are placed within the tube assembly chamber with protective caps thereon to prevent contamination from the processing of the photocathodes. Once the photocathodes have been processed within the processing chamber, the protective caps are removed from the vacuum tube housings by means of a magnetic manipulator.

After removal of the caps and subsequent processing of tube housings, an automated transfer mechanism lifts each photocathode out of its receptacle in the photocathode processing chamber and places each photocathode into another receptacle within the tube assembly chamber. As the photocathodes are placed into the tube assembly chamber, they are positioned within the various vacuum tube housings. The receptacles within the tube assembly chamber are disposed upon a rotating platform. After all the photocathodes have been loaded, the receptacles are rotated to coact with a press mechanism. The press mechanism presses the photocathode into the vacuum tube housing creating an air tight seal between both components. After all the photocathodes have been sealed, the tube assembly chamber is vented to ambient pressure and the finished sealed vacuum tubes are removed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system can be used in manufacturing many different types of vacuum tubes, such as Gem III image intensifier tubes, X-ray image intensifier tubes and the like, the present invention is especially suitable for use in manufacturing Gen. II image intensifier tubes. Accordingly, the present invention will be described in connection with the manufacturing procedure for a Gen. II image intensifier tube.

Figure 1:
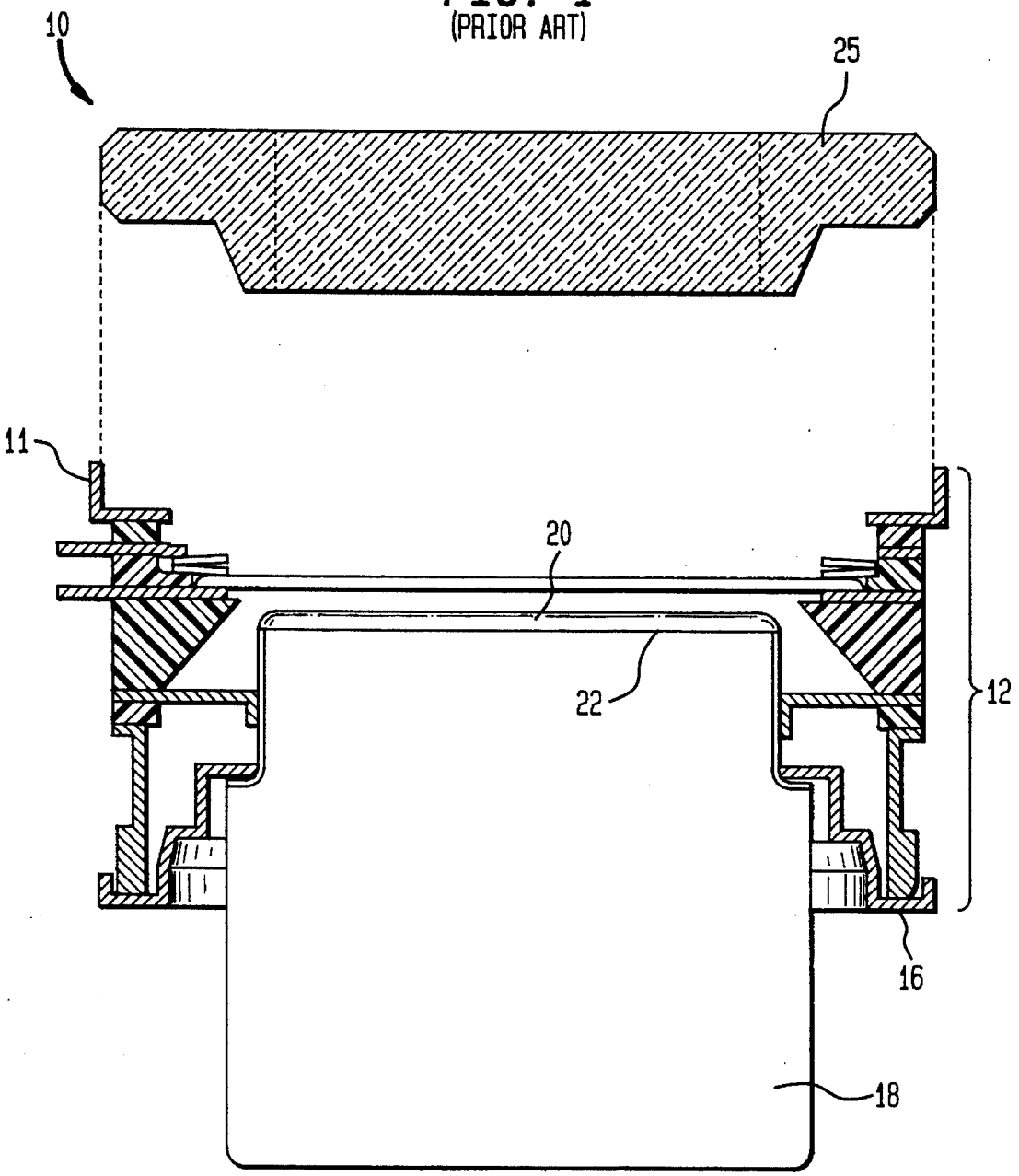
FIG. 1 (PRIOR ART)
FIG. 1 is a cross-sectional view of a prior art Gen. II image intensifier tube to help illustrate the components assembled by the present invention assembly system and method.
Figure 2:
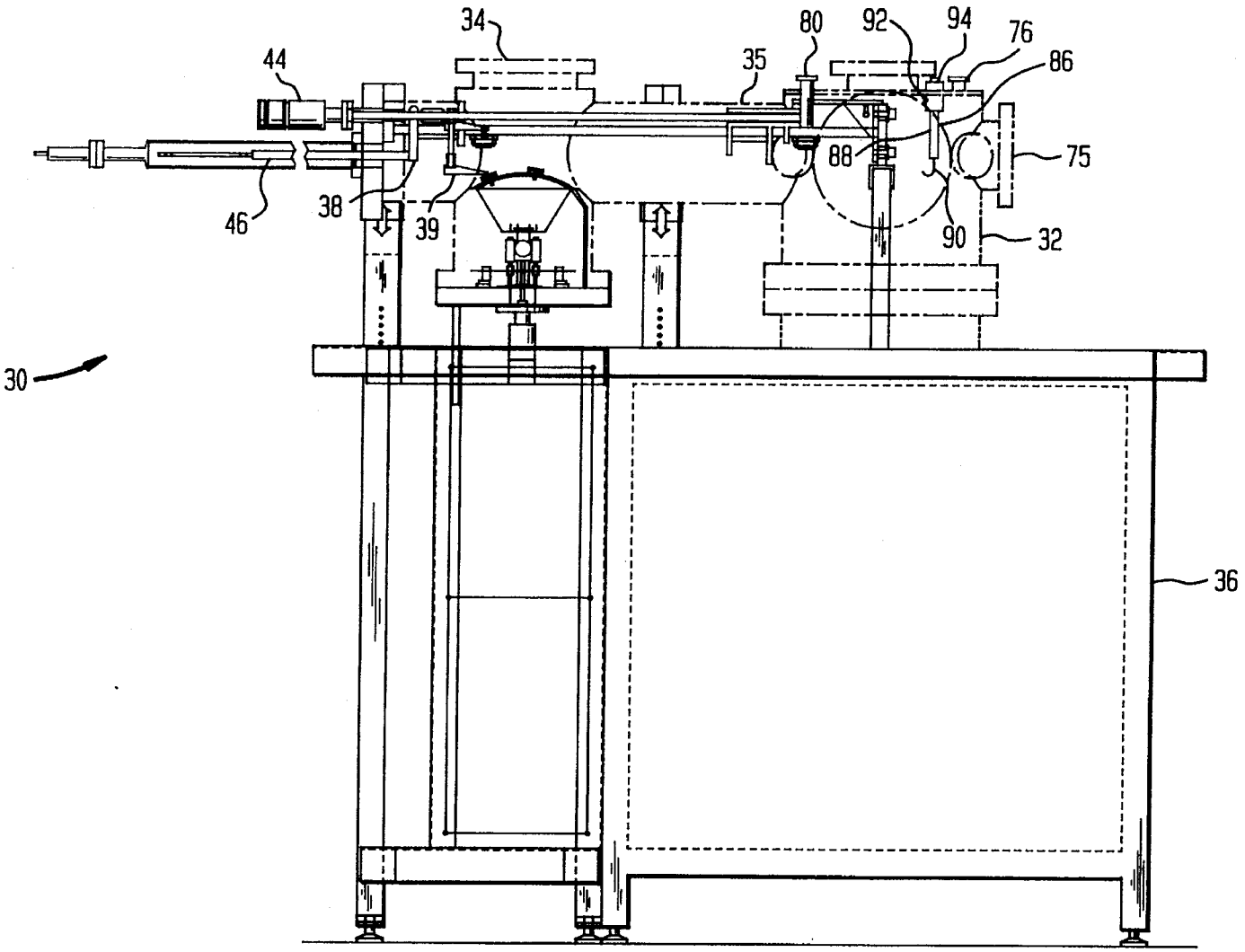
FIG. 2 is a side cross-sectional view of one preferred embodiment of the present invention assembly system and method.

Referring to FIG. 2, the present invention high throughput assembly system 30 is shown for assembling photocathodes onto tube subassemblies so as to create Gen. II image intensifier tubes. The automated assembly system 30 includes two separate stations, those stations being the main tube chamber 32 for holding a plurality of image intensifier tubes and an ancillary process chamber 34 for processing a plurality of photocathodes. Each of the two chambers 32,34 is a vacuum vessel capable of withstanding a vacuum of at least $10^{-10}$ millitorrs. In the preferred embodiment of the invention, the main tube chamber 32 is connected to the ancillary process chamber 34 by means of a hollow channel 35 having no intervening gate valves therein. The automated assembly system is mounted atop a base unit 36, such as laboratory table or other suitable support. A vacuum pumping system (not shown) is included within the base unit 36 and is coupled to the main chamber 32. The fact that there are no intervening valves separating the main chamber 32 and the ancillary process chamber 34 effectively makes the chambers into a common vessel. Consequently, this allows each of the chambers 32,34 to be evacuated by the same vacuum source.

Figure 3:
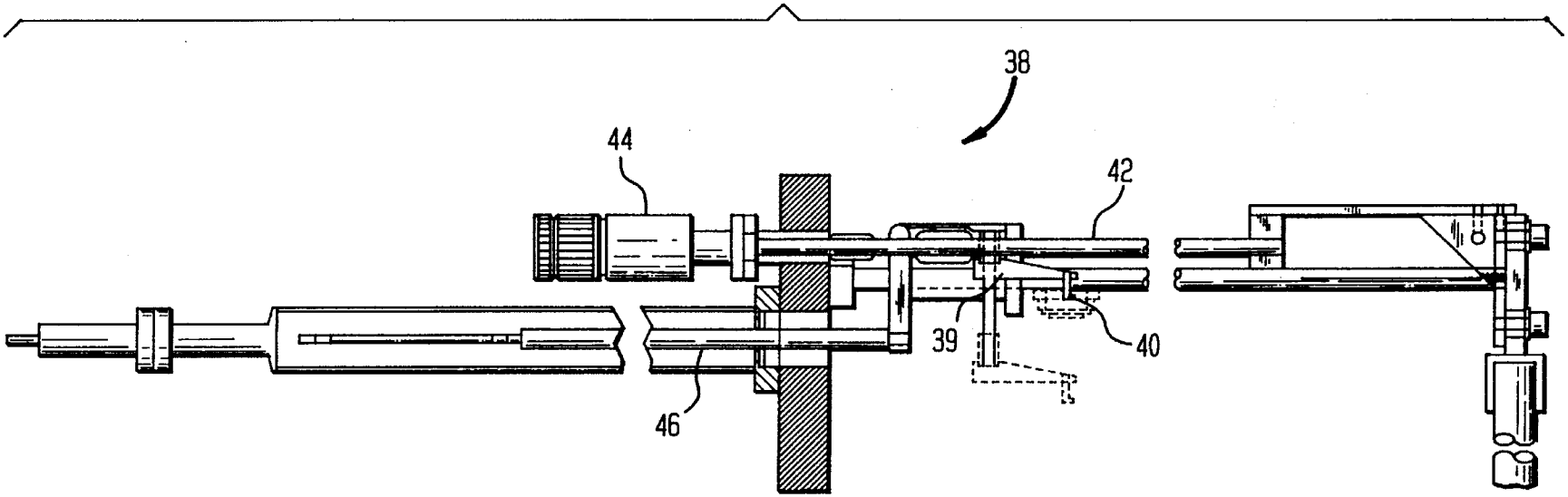
FIG. 3 is a detailed side view of an automated transfer mechanism according to the present invention.

Referring to FIG. 3, in conjunction with FIG. 2, it can be seen that an automated transfer mechanism 38 is positioned adjacent to the process chamber 34 and extends throughout the system 30 into both the process chamber 34 and the tube chamber 2. The automated transfer mechanism 38 includes a transfer arm 39 having a gripping device 40 at one end, for example, a pickup finger, adapted to engage and manipulate photocathodes. In the shown embodiment, the transfer arm 39 travels along a guide rail 42 in a linear range of motion and is capable when moved of extending across the process chamber 34 and into the main chamber 32. As can be seen the transfer arm 39 is capable of vertical up and down movement in order to engage and carry a photocathode from the process chamber to the tube chamber. In the preferred embodiment of the invention, the transfer arm 39 is coupled by means of a cable to a circulating shaft 44. The circulating shaft 44 is adapted to take up and release the cable, thereby maneuvering the transfer arm 39 in the vertical direction. Push rod 46 is adapted to mechanically manipulate the transfer arm in the horizontal back and forth direction. The movement of the transfer arm 39 can be controlled through many well known prior art control mechanisms. It will be understood, however, that the automated transfer mechanism 38 need not be an elongated transfer arm but may be any known transfer device, such as robot arm, or the like, capable of repeatedly engaging photocathodes in the process chamber 34 and moving those photocathodes into the tube chamber 32.

Figure 4:
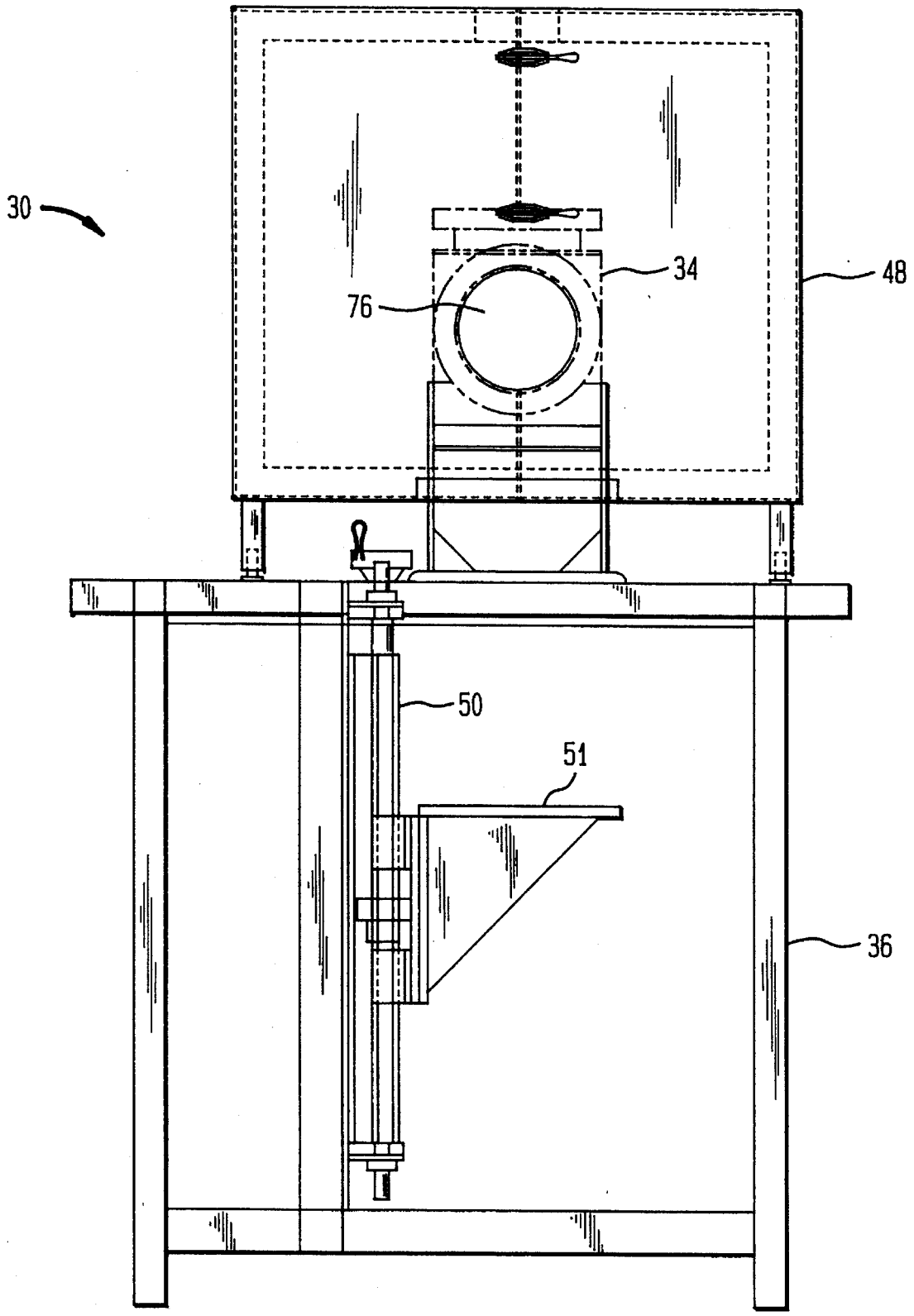
FIG. 4 is front view of the present invention assembly system illustrating the inclusion of baking enclosures around the processing chambers.

Referring to FIG. 4, there is shown a front view of the present invention assembly system 30, which shows the process chamber 34 surrounded by a portable baking oven 48. The system 30 includes two separate ovens, each of which is adapted to entirely surround the process chamber 34 and the tube chamber 32, respectively. The ovens are capable of producing temperatures in excess of 375° C. and are used to bake off contaminants during different portions of the manufacturing process. The customized ovens are lightweight and portable so that they can be easily removed from around the chambers 32, 34, when not required. FIG. 4 also illustrates the presence of a hoist mechanism 50 which is mounted to the base unit 36. The hoist mechanism 50 includes a shelf 51 that is adapted to be raised and lowered from floor level to chamber level and vice versa. Photocathodes 25 are manually loaded into a photocathode receptacle before being loaded into the process chamber 34. The photocathode receptacle, when fully loaded, can weigh in excess of 40 lbs., thus, the hoist mechanism is utilized to carefully and efficiently raise a loaded photocathode receptacle from transport level to chamber level. It will be understood that the hoist mechanism may be any well known mechanical device for attachment to a table or base unit and adapted to vertically transport a load.

Figure 5:
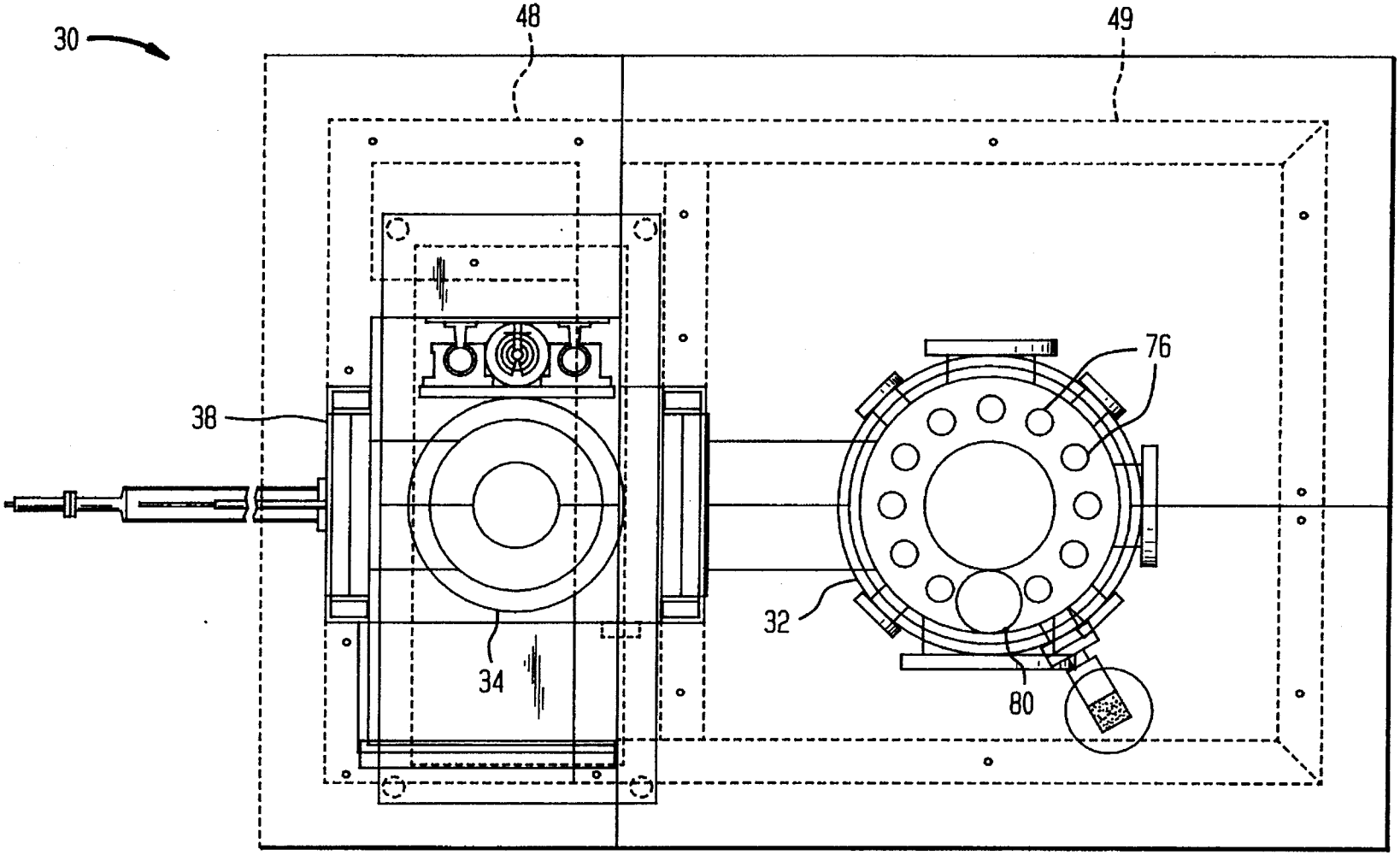
FIG. 5 is a top plan view of one preferred embodiment of the present invention automated assembly system.

Referring to FIG. 5, there is shown a top view of the high throughput system 30. The main tube chamber 32 consists of 12" diameter bell jar suitable for vacuum applications and having a pumping system in its base. The main tube chamber 32 holds fixturing to mount twelve image intensifier tubes of 18 mm or 25 mm useful diameter. The tubes are mounted on a rotary tray so that they can be oriented in succession opposite the process chamber 34 to receive cathodes, or under ram 80 for sealing. The process chamber 34 holds fixturing necessary to form twelve 18 mm diameter cathodes with a single process. When appropriate, the automated transfer mechanism 38, automatically transfers photocathodes from the process chamber 34 to the main tube chamber 32 for sealing.

Figure 6:
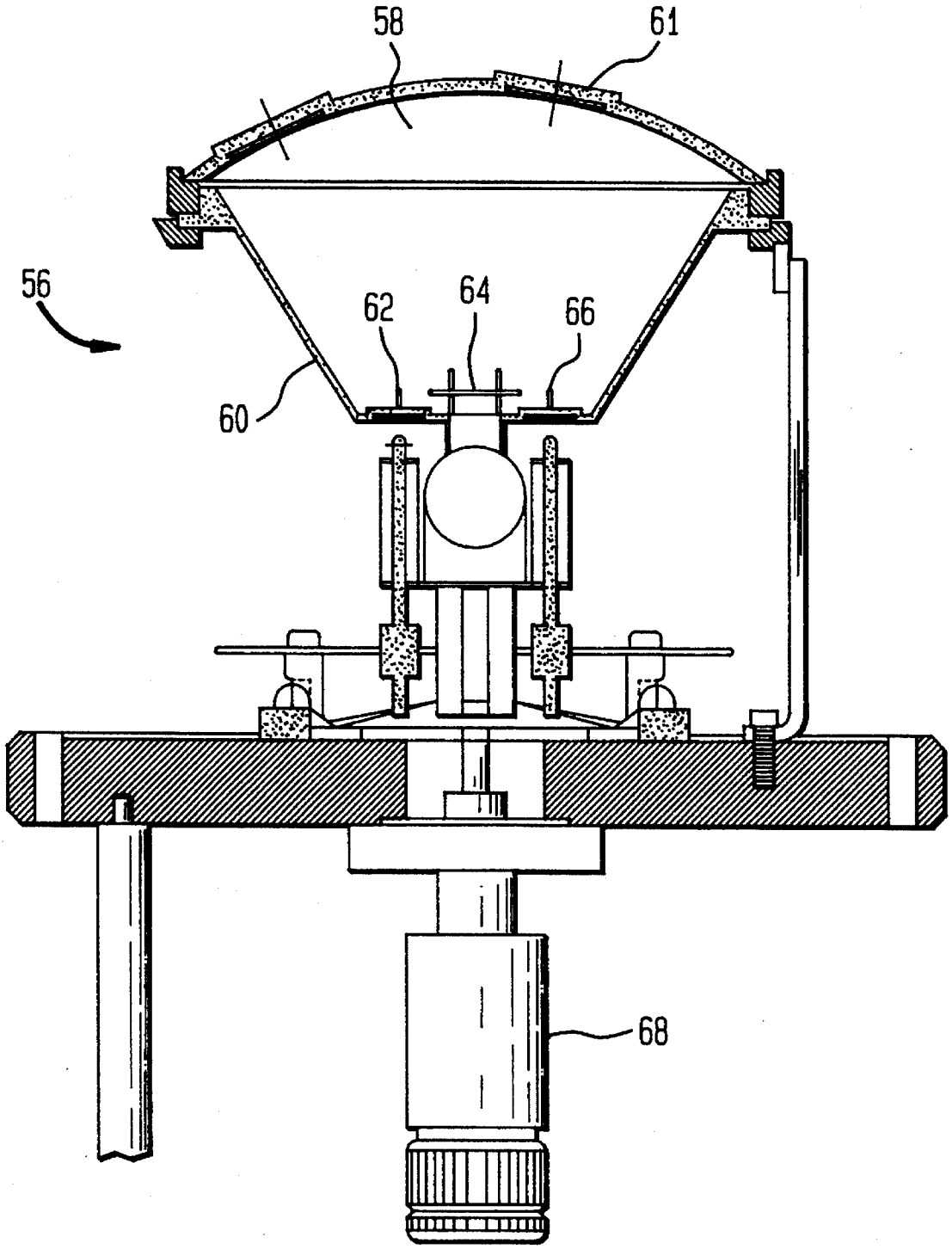
FIG. 6 is a side cross-sectional view of a photocathode processing assembly according to the present invention.
Figure 7B:
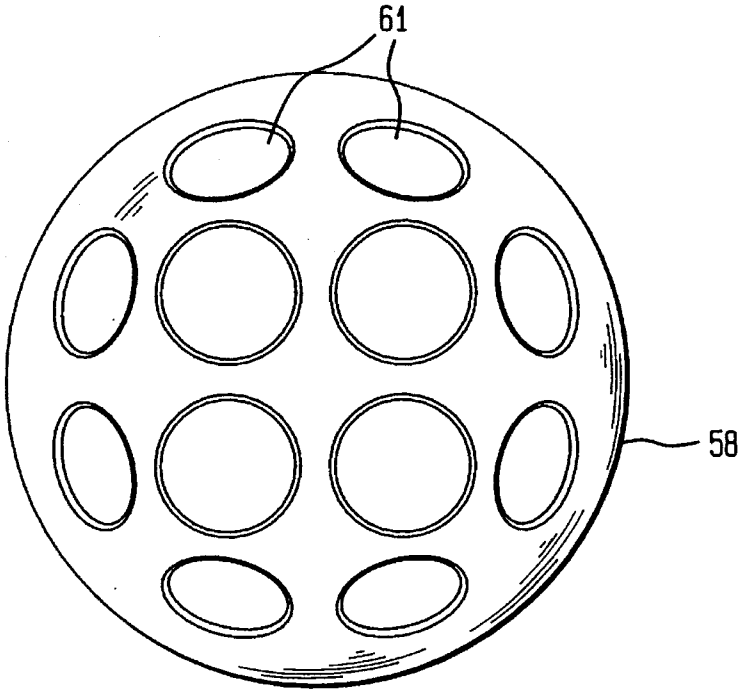
FIG. 7B is a top view of a photocathode receptacle platform according to the present invention.

Referring to FIG. 6, there is shown a detailed view of the process can assembly 56 that is located within the process chamber 34. The can assembly 56 includes a photocathode receptacle 58, which is removable and adapted to mount atop the process can 60. Referring to FIG. 7B, in conjunction with FIG. 6, it can be seen that the photocathode receptacle 58 is essentially a dome-like structure containing twelve photocathode holding areas 61 which are equally distributed about the surface of the dome. The bottom portion of the process can 60 includes three venting structures 62,64,66 which are adapted to selectively release various gaseous substances from within, for example, antimony, cesium and sodium. The base of the process can assembly 56 includes a rotary motion device 68, such as a motor or other motion producing means. The rotary motion device 68 allows the process can 60 to be selectively rotated about a central axis in order that the automated transfer device 38 can access a selected photocathode. Vacuum chambers that include rotating platforms and/or assemblies are commercially available and are a commonly used piece of manufacturing equipment. Several models of such vacuum chambers are sold by Varain Inc. of Italy. Another example of a prior art rotating table that is used in the manufacturing of image intensifier tubes is shown in U.S. Pat. No. 5,178,546 to Dickerson, entitled CONTACT APPARATUS FOR COUPLING TERMINALS WHICH MOVE WITH RESPECT TO ONE ANOTHER issued on Jan. 12, 1993 and assigned to ITF Corporation, the assignee herein.

Although rotating platforms are commercially available, the adaptation of such a platform to a specific manufacturing application differs from product to product. In the present invention assembly system 30, the photocathode receptacle 58 in the process chamber 34 is custom made to retain the photocathodes 25 in a set orientation on the can assembly 56. In the shown embodiment, the process can assembly 56 rotates in conjunction with the rotary motion device. Disposed underneath the photocathode receptacle is a customized process can 60 which includes the instrumentation required to process the photocathodes prior to assembly to the image intensifier tubes. The process can assembly 56 allows all (twelve) of the photocathodes to be treated in a single process. FIG. 4, also illustrates the two oven enclosures 48, 49 used to surround both the process chamber 34 and the tube chamber, 32, respectively.

Figure 7A:
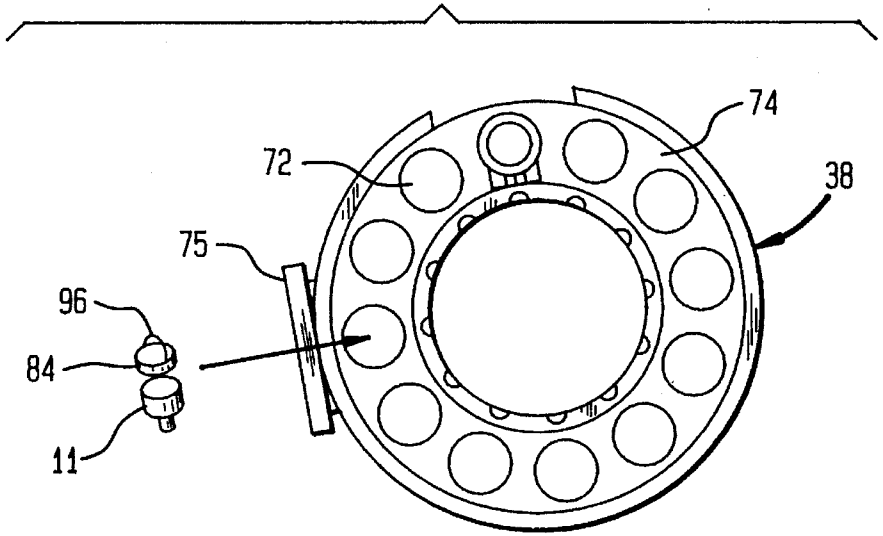
FIG. 7A is a top view of an embodiment of the tube chamber of the assembly system shown in FIG. 2 having its upper region removed to expose internal components and facilitate consideration and discussion.

Referring to FIG. 7A the tube body chamber 32 includes a rotary platform 74 upon which are positioned a plurality of receptacles 72. The receptacles 72 are positioned at points along the rotating platform 74. As will be explained, the receptacles 72 are adapted to receive and hold completed image intensifier tube assemblies. Prior to the start of the automated assembly process, tube subassemblies 11 are placed into the receptacles 72 on the rotating platform 74. The tube subassemblies are placed into the tube chamber 32 with protective caps 84 thereon to prevent contamination from the processing of the photocathodes. Once the photocathodes have been processed within the processing chamber 34, the protective caps 84 are removed from the vacuum tube housings by means of a magnetic manipulator 86. (shown in FIG. 2). The tube subassemblies 11 can be placed into the tube body assembly station 38 by an automated machine or may be manually placed into the receptacles 72 through the window port 75.

Similarly the process chamber is loaded through the window port 76 (shown in FIG. 4) As discussed a fully loaded photocathode receptacle 58 is delivered to the process chamber 34 with the assistance of the hoist mechanism 50. The receptacle is then interchanged with an empty receptacle from the previous process, wherein the receptacle 58 is attached to the process can 60. Once the receptacle 58 has been fastened within the process chamber and once a tube subassembly 11 is placed in each receptacle 72 on the rotating platform 74 of the tube chamber 32, the respective window ports 75,76 on each of the chambers 32,34 are closed. The chambers, which are essentially one common vessel, are then evacuated by means of the pumping station and baked clean.

The baking is accomplished in order to clean the photocathodes and/or the tubes subassembly and to eliminate any contaminants within the chambers 32,34 or on the components prior to the processing step. As discussed previously, the contents of the two chambers may be baked by installing the two portable oven enclosures 48,49 around each of the respective chambers. Since there is an oven enclosure associated with each chamber, the contents of the chambers 32,34 may be baked separately or at the same time, depending on the application. When in full bake mode, the temperature of the chambers will reach in excess of 375° C.

At the termination of the heat cleaning operation, all of the photocathodes 25 are allowed to cool down over a predetermined cool-down period. In order to expedite the cool-down, the oven 48 around at least the process chamber is removed from around the chamber 34 and off of the support 36. Before the photocathodes can be processed, the temperature within the process chamber must be at approximately 200° C. Once the photocathodes have cooled sufficiently, the three channels 62,64,66 within the process well of the can assembly 56 are selectively vented so that their contents are evaporated within the process chamber 34 and onto the photocathodes. In this case a mixture of antimony, sodium, cesium and potassium is released from the channels and is evaporated into the chamber. The mixture forms a crystalline structure onto the face of the photocathode which has the photosensitive characteristics required by the final image intensifier structure.

Once the photocathodes 25 have been processed, depending upon the specific application, the cathodes may be baked a second time to remove any contaminants before the cathodes are finally assembled to the tubes 11. This would entail attachment of the oven enclosure 48 around the process chamber 34. If the second baking step is carried out, the photocathodes must again be allowed to cool before being transferred to the tube chamber. Similarly, the baking of the tube chambers 32 cleans contaminants from both from the tube chambers 32 itself and the tube subassemblies 11 held within the tube chamber 32. After the tube chamber 32 is baked, the tube chamber 32 and the tube subassemblies 11 it contains are also allowed to cool for a predetermined period.

After the processing of the photocathodes and after the tube chamber 32 and the tube subassemblies 11 are baked and cooled, the protective caps 84 are removed from the tube subassemblies 11 by means of a magnetic manipulator 86. (shown in FIG. 2). The manipulator is a rod 88 the hook 90 at one end and a magnet 92 at the other end which attaches to the interior of the chamber 32. A corresponding magnetic handle 94 outside of the chamber 32 magnetically couples with the interior magnet 92 of the manipulator 86 thus, the manipulator 86 can be manually manipulated around the tube chamber 32 to remove the protective caps 84 from the tube subassemblies 11 prior to their processing. As can be seen from FIG. 7A, the protective caps include a handle device 96 so as to be easily engaged by the hook 90 of the manipulator 86.

Electron floodguns 76 (shown from above in FIG. 5) are disposed above each of the receptacles 72 within the tube body assembly station 38. Consequently, an electron floodgun 76 is disposed above each of the tube subassemblies 11 held within the receptacles 72. The electron floodguns 76 are activated and the electron floodguns 76 bombard each of the tube subassemblies 11 with an electron beam, thereby scrubbing the tube subassemblies 11 and outgassing the components of each tube subassembly. After a predetermined scrub period, the electron floodguns 76 are disabled and the getters contained within each tube subassembly 11 are flashed.

Once the tube assemblies 11 have been baked, scrubbed and their getters flashed, and provided the tubes and photocathodes have been sufficiently cooled, the photocathodes are ready to be transferred to the tube chamber 32. The transfer arm 39, of the automated transfer mechanism 38, then proceeds to retrieve photocathodes 25 from the photocathode process chamber 34 and place those photocathodes 25 into the tube chamber 32. It will be understood that the process can assembly 56 will be automatically rotated so that a cathode holding area 61 of the cathode receptacle 58 will be directly in line with the transfer arm of the linear motion automated transfer mechanism 38. The photocathodes 25 are moved by the transfer arm 67 one at a time. As the transfer arm 39 transfers a photocathode 25 into the tube chamber 32, the transfer arm 39 places the photocathode 25 into a receptacle 72 on the rotating platform 74 directly upon the tube subassembly 11 already in that position. Once a photocathode 25 is properly positioned by the transfer arm 39, the transfer arm 39 retreats to retrieve the next subsequent photocathode from the process chamber 34 and the rotating platform 74 of the tube body assembly station 38 rotates to ready the next subsequent receptacle 72 for the next photocathode. It will be understood that the automated transfer mechanism 38, the process can assembly 56 and, the rotatory platform 74 and tube chamber are operated in conjunction with one another, wherein the timing and operations of the system 30 are orchestrated by means of microprocessor or computer regulated control mechanism (not shown), which is known in the art. In the alternative parts of the system may also be operated manually.

Once a photocathode 25 has been placed atop each of the tube assemblies 11 in the tube chamber 32, the tube subassemblies and photocathodes can be assembled. A press mechanism 80 (shown from above in FIG. 5) is disposed above the rotating platform 74 of the tube body assembly station 38 at one set position. The rotating platform 74 rotates in a stepped fashion, positioning each of the receptacles 72 under the press mechanism 80 for a short duration of time. When a receptacle 72 is positioned under the press mechanism 80, the ram of the press mechanism 80 descends and engages the photocathode 25 that is disposed atop the tube subassembly 11. The press mechanism presses the photocathode 25 into the tube subassembly 11 wherein an airtight cold indium seal is created between the photocathode 25 and the tube subassembly 11. The press mechanism 80 then retreats, the rotating platform 74 rotates and the process is repeated until all the photocathodes 25 are sealed to the tube subassemblies 11. After all the tubes are sealed, the tube body assembly station 38 is vented and the finished image intensifier tubes removed.

As an optional step, the process chamber 34 may be baked clean before each new batch of photocathodes is loaded into the photocathode process chamber. As a result, any cesium build up from the processing of the photocathodes can be removed from the photocathode chamber after each batch of photocathodes are processed. Similarly, the tube chamber may also be baked to eliminate contaminants.

Thus, the instant invention presents an innovative new system and method for the efficient assembly of image intensifier tubes. This system saves on hardware costs, since only two vacuum chambers are required and the chambers need not be separated by any intervening gate valves. Accordingly, only a single vacuum source and pumping station is required for the entire system. The system also is designed to process an entire batch of photocathodes in a single step.

It will be understood that the embodiment described herein is merely exemplary and that a person skilled in the art may make many variations and modifications to the described embodiments utilizing functionally equivalent elements and mechanisms to those described. More specifically, it will be understood that the various vacuum chambers may arranged in any orientation and may include additional process stations to those described. All such variations and modifications are intended to be included within the scope of this invention as defined by the appended claims.

What is claimed is:

1. An automated system for assembling photocathodes into vacuum tube housing, comprising:

a first chamber capable of retaining an evacuated environment;

first holding means for holding a plurality of photocathodes introduced into said first chamber;

a second chamber capable of retaining an evacuated environment, said second chamber being coupled to said first chamber by an open channel, thereby forming a common vessel, wherein said first chamber and said second chamber are coupled to a common vacuum source;

second holding means for holding a plurality of vacuum tube housings in said second chamber;

automated transfer means for individually transferring said plurality of photocathodes from said first chamber to said tube housing; and a sealing device disposed within said second chamber wherein said sealing device seals said photocathode within said vacuum tube housing.

2. The system according to claim 1, further including processing means disposed within said first chamber for depositing material onto a surface of said plurality of photocathodes in a single step.

3. The system according to claim 1, further including heating means selectively attachable to said first and second chambers and adapted to bake the contents within said chambers.

4. The system according to claim 1, wherein said first holding means includes a removable receptacle having a plurality of holding areas adapted to receive said plurality of photocathodes.

5. The system according to claim 1, wherein said second chamber includes a plurality of receptacles disposed on a rotating platform, wherein a vacuum tube housing fits into each of said receptacles.

6. The system according to claim 1, wherein said automated transfer means transfers each photocathode from said first chamber and places each photocathode upon a vacuum tube housing in said second chamber.

7. The system according to claim 1, wherein said sealing device includes a press that presses each photocathode into each vacuum tube housing creating an air impervious seal between the photocathode and the vacuum tube housing.

8. The system of claim 1, wherein said automated transfer means includes a transfer arm adapted to move in a linear range of motion in a horizontal direction, as well as vertically up and down, said transfer arm being operable to pick up and release a selected one of said photocathodes.

9. The system of claim 1 further including magnetic manipulation means adapted to selectively engage and remove protective caps disposed on said plurality of vacuum tube housing in said second chamber.

10. The system according to claim 1, further including a cleaning means disposed within said second chamber for cleaning said plurality of vacuum tubes in said second chamber.

11. The system according to claim 10, wherein said cleaning means includes a plurality of electron guns disposed above said at least one vacuum tube in said second chamber, wherein each of said electron guns bombards one of said plurality of vacuum tubes.

12. The system according to claim 1, wherein said processing means includes a plurality of separate channels for elaboratively releasing a plurality of substances into said first chamber and onto the surface of said photocathodes.

13. The system of claim 12, wherein said channels are adapted to release antimony, potassium, cesium and sodium, thereby forming a photosensitive crystalline layer on the surface of said photocathodes.

14. A method of assembling photocathodes into vacuum tube housing, comprising the steps of:

loading a plurality of photocathodes into a first chamber;

loading a plurality of vacuum tube housing into a second chamber, each of said vacuum tube housing including a protective cap;

evacuating said first chamber and said second chamber as a common vessel;

processing said photocathodes within said first chamber;

removing said protective cap from each one of said plurality of vacuum tube housings;

processing said vacuum tube housings within said second chamber;

automatically transferring individual ones of said photocathodes from said first chamber to said second chamber; and assembling photocathodes to said vacuum tube housings in said second chamber, thereby forming a plurality of vacuum tube assemblies.

15. The method according to claim 14, further including the step of coating a surface of said photocathodes with a deposition material in said first chamber.

16. The method according to claim 14, wherein said step of processing said vacuum tube housings includes exposing said housings to an electron beam.

17. The method according to claim 14, wherein said step of transferring said photocathodes from said first chamber to said second chamber includes providing an automated transfer mechanism between said first chamber and said second chamber wherein said automated transfer mechanism engages individual ones of said photocathodes in said first chamber, transfers said photocathodes to said second chamber and deposits said photocathodes in said second chamber at a set position.

18. The method according to claim 14, wherein said step of assembling said photocathodes to said vacuum tube housings includes pressing a photocathode into a vacuum tube forming an air tight seal.

19. The method according to claim 18, further including the step of baking said first chamber and second chamber to remove contaminants.

20. An automated system for assembling photocathodes into vacuum tube housings, comprising:

a first chamber capable of retaining an evacuated environment;

first holding means for holding a plurality of photocathodes introduced into said first chamber;

a second chamber capable of retaining an evacuated environment, said second chamber being coupled to said first chamber by an open channel, thereby forming a common vessel;

second holding means for holding a plurality of vacuum tube housings in said second chamber;

automated transfer means for individually transferring said plurality of photocathodes from said first chamber to said second chamber wherein each photocathode is placed on a vacuum tube housing;

a sealing device disposed within said second chamber wherein said sealing device seals said photocathode within said vacuum tube housing; and magnetic manipulation means adapted to selectively engage and remove protective caps disposed on said plurality of vacuum tube housings in said second chamber.

* * * * *